US009793627B2

(12) United States Patent
Omori et al.

(10) Patent No.: US 9,793,627 B2
(45) Date of Patent: Oct. 17, 2017

(54) GROUND TERMINAL FITTING

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Yasuo Omori, Mie (JP); Kohei Takagi, Mie (JP); Masaaki Tabata, Mie (JP)

(73) Assignees: AUTONETWORKS TECHNOLOGIES, LTD., Yokkaichi, Mie (JP); SUMITOMO WIRING SYSTEMS, LTD., Yokkaichi, Mie (JP); SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 15/514,628

(22) PCT Filed: Sep. 28, 2015

(86) PCT No.: PCT/JP2015/077255
§ 371 (c)(1),
(2) Date: Mar. 27, 2017

(87) PCT Pub. No.: WO2016/059962
PCT Pub. Date: Apr. 21, 2016

(65) Prior Publication Data

US 2017/0222339 A1 Aug. 3, 2017

(30) Foreign Application Priority Data

Oct. 17, 2014 (JP) ..... 2014-212192

(51) Int. Cl.
*H01R 11/11* (2006.01)
*H01R 11/12* (2006.01)
(Continued)

(52) U.S. Cl.
CPC ..... *H01R 11/12* (2013.01); *H01R 4/185* (2013.01); *H01R 4/64* (2013.01)

(58) Field of Classification Search
CPC ..... H01R 11/12
(Continued)

(56) References Cited

U.S. PATENT DOCUMENTS 4,126,367 A * 11/1978 Miller ..... H01R 11/03 439/504
4,921,443 A 5/1990 Sato
(Continued)

FOREIGN PATENT DOCUMENTS

JP 2-41370 3/1990
JP S11-001437 1/1996
(Continued)

OTHER PUBLICATIONS

International Search Report dated Nov. 17, 2015.

*Primary Examiner* — Phuong Dinh
(74) *Attorney, Agent, or Firm* — Gerald E. Hespos; Michael J. Porco; Matthew T. Hespos

(57) ABSTRACT

A ground terminal fitting includes a bolt fastening portion (11) to be bolted to a ground part (40) and a wire connecting portion (12) to be connected to an end part of a wire (30). The bolt fastening portion (11) and a bottom plate portion (18) of the wire connecting portion (12) are arranged flush with each other. A protrusion (21) projecting toward the ground part (40) is provided on a part of the bolt fastening portion (11) around a bolt insertion hole (14) through which a bolt (41) is to be inserted. Since a linking portion (13)
(Continued)

lining the bolt fastening portion (11) and the wire connecting portion (12) needs not be formed into a bent shape according to this configuration, a stress concentration on the linking portion (13) can be alleviated.

2 Claims, 6 Drawing Sheets

(51) Int. Cl.
*H01R 4/64* (2006.01)
*H01R 4/18* (2006.01)

(58) Field of Classification Search
USPC ..... 439/883
See application file for complete search history.

(56) References Cited

U.S. PATENT DOCUMENTS 4,983,133 A * 1/1991 Van Scyoc ..... H01R 11/12 439/860
5,030,131 A * 7/1991 Boehm ..... H01R 4/36 439/387
5,934,923 A * 8/1999 Matsuoka ..... H01R 11/12 439/287
6,361,384 B1 * 3/2002 Manor ..... H01R 4/307 439/557
7,530,843 B1 * 5/2009 Tesfay ..... H01R 4/183 439/587
8,870,610 B2 * 10/2014 Tsuji ..... H01R 4/029 439/874
2016/0036141 A1 * 2/2016 Lawson ..... H01R 11/12 439/784
2016/0156111 A1 * 6/2016 Forsyth ..... H01R 4/06 439/883

FOREIGN PATENT DOCUMENTS

| | | |
|---|---|---|
| JP | 2000-67944 | 3/2000 |
| JP | 2000-285983 | 10/2000 |
| JP | 2002-315130 | 10/2002 |
| JP | 2003-297447 | 10/2003 |
| JP | 2006-286385 | 10/2006 |
| JP | 2007-234300 | 9/2007 |
| JP | 2013-98160 | 5/2013 |

* cited by examiner

GROUND TERMINAL FITTING

BACKGROUND

1. Field of the Invention

The present invention relates to a ground terminal fitting.

2. Description of the Related Art

A conventional ground terminal fitting is connected to an end part of a wire and is connected to a predetermined ground part by bolting. This ground terminal fitting includes a bolt fastening portion to be bolted to the ground part and a wire connecting portion to be connected to the end part of the wire.

Some ground terminal fittings cover a connecting part of the wire and the ground terminal fitting with a water stopping member, such as a heat shrinkable tube, for example, as described in Japanese Unexamined Patent Publication No. 2000-285983, to prevent the intrusion of water into the interior of the wire from the end part of the connected wire. A linking portion that links the bolt fastening portion and the wire connecting portion needs to be formed into a bent shape by lifting the wire connecting portion from the ground part to ensure a space into which the water stopping member is to be inserted.

However, the linking portion that links the bolt fastening portion and the wire connecting portion has a smaller width as compared to other parts. Thus, a force due to vibration or the like tends to act on the linking portion in a concentrated manner. Forming such a linking portion into a bent shape creates a stress concentration that gradually reduces strength and may consequently lead to breakage over a long period of time. Thus, a countermeasure has been desired.

The present invention was completed based on the above situation and aims to provide a ground terminal fitting capable of alleviating a stress concentration on a linking portion.

SUMMARY

The invention is directed to a ground terminal fitting with a bolt fastening portion to be bolted to a ground part, and a wire connecting portion to be connected to an end part of a wire. The bolt fastening portion and a bottom plate of the wire connecting portion are arranged flush with each other, and a protrusion projecting toward the ground part is provided on a part of the bolt fastening portion around a bolt insertion hole through which a bolt is to be inserted. The ground terminal fitting may be configured so that the protrusion has a ring shape by being provided over the entire circumference of the bolt insertion hole. According to this configuration, since the protrusion has a high strength, grounding can be established satisfactorily.

According to the present invention, the protrusion provided around the bolt insertion hole comes into contact with the ground part to lift the wire connecting portion from the ground part and a space for a water stopping member is provided below the wire connecting portion. Thus, the linking portion that links the bolt fastening portion and the wire connecting portion need not be formed into a bent shape, with the result that a stress concentration on the linking portion can be alleviated.

DETAILED DESCRIPTION

Hereinafter, one specific embodiment of the present invention is described in detail with reference to FIGS. 1 to 6.

Figure 1:
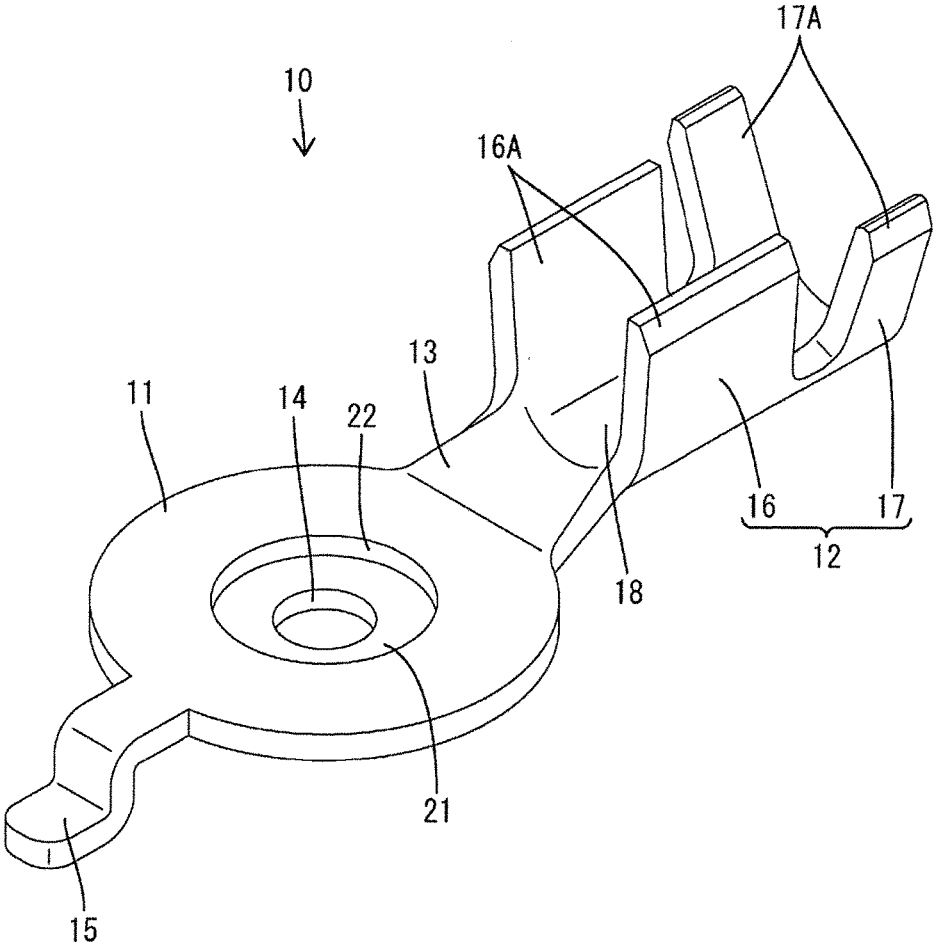
FIG. 1 is a perspective view showing a ground terminal fitting in an embodiment.

A ground terminal fitting in this embodiment is connected to an end part of a wire 30 and grounded, for example, by being connected to a predetermined ground part 40 on a body of an automotive vehicle by bolting. In the following description, a left-front side, a right-back side, an upper side and a lower side of FIG. 1 are referred to as a front side, a rear side, an upper side and a lower side in each constituent member.

The ground terminal fitting 10 is formed by press-working a metal plate material and includes a bolt fastening portion 11 to be bolted to the ground part 40 and a wire connecting portion 12 to be connected to the end part of the wire 30. The bolt fastening portion 11 and the wire connecting portion 12 are linked integrally by a linking portion 13.

Figure 5:
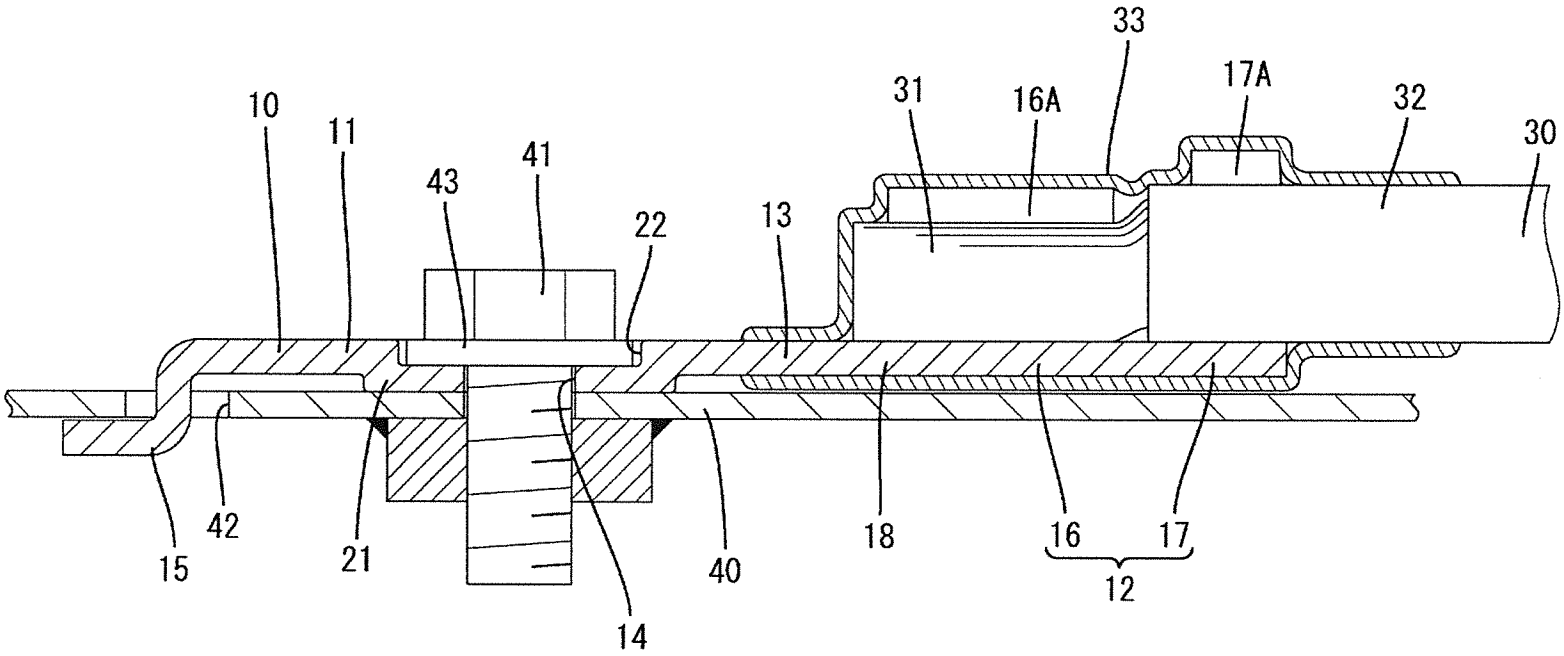
FIG. 5 is a section showing a state where the ground terminal fitting is connected to the wire and covered with a heat shrinkable tube.

The bolt fastening portion 11 is substantially in the form of a circular flat plate and a substantially circular bolt insertion hole 14 penetrates through a central part of the bolt fastening portion 11 for receiving a bolt 41. The bolt fastening portion 11 is formed integrally with a rotation stopping portion 15 for preventing co-rotation. The rotation stopping portion 15 is bent down and forwardly after extending horizontally (substantially in parallel to the plate surface of the bolt fastening portion 11) in a radially outward direction from the outer peripheral edge of the bolt fastening portion 11. The tip of this rotation stopping portion 15 is inserted into a groove 42 provided in the ground part 40, as shown in FIG. 5, to stop the rotation of the bolt fastening portion 11.

The wire connecting portion 12 includes a core crimping portion 16 to be crimped to a core 31 of the wire 30 and a coating crimping portion 17 to be crimped to an insulation coating 32. The core crimping portion 16 and the coating crimping portion 17 respectively include two core crimping pieces 16A and two coating crimping pieces 17A projecting up from both side edges of a bottom plate 18. The bottom plate 18 in the wire connecting portion 12 is curved so that a substantially center in a width direction is lowest and the side edges are raised. The core crimping pieces 16A and the coating crimping pieces 17A are caulked for respectively embracing the core 31 and the insulation coating 32 of the wire 30 placed on the bottom plate 18.

Figure 4:
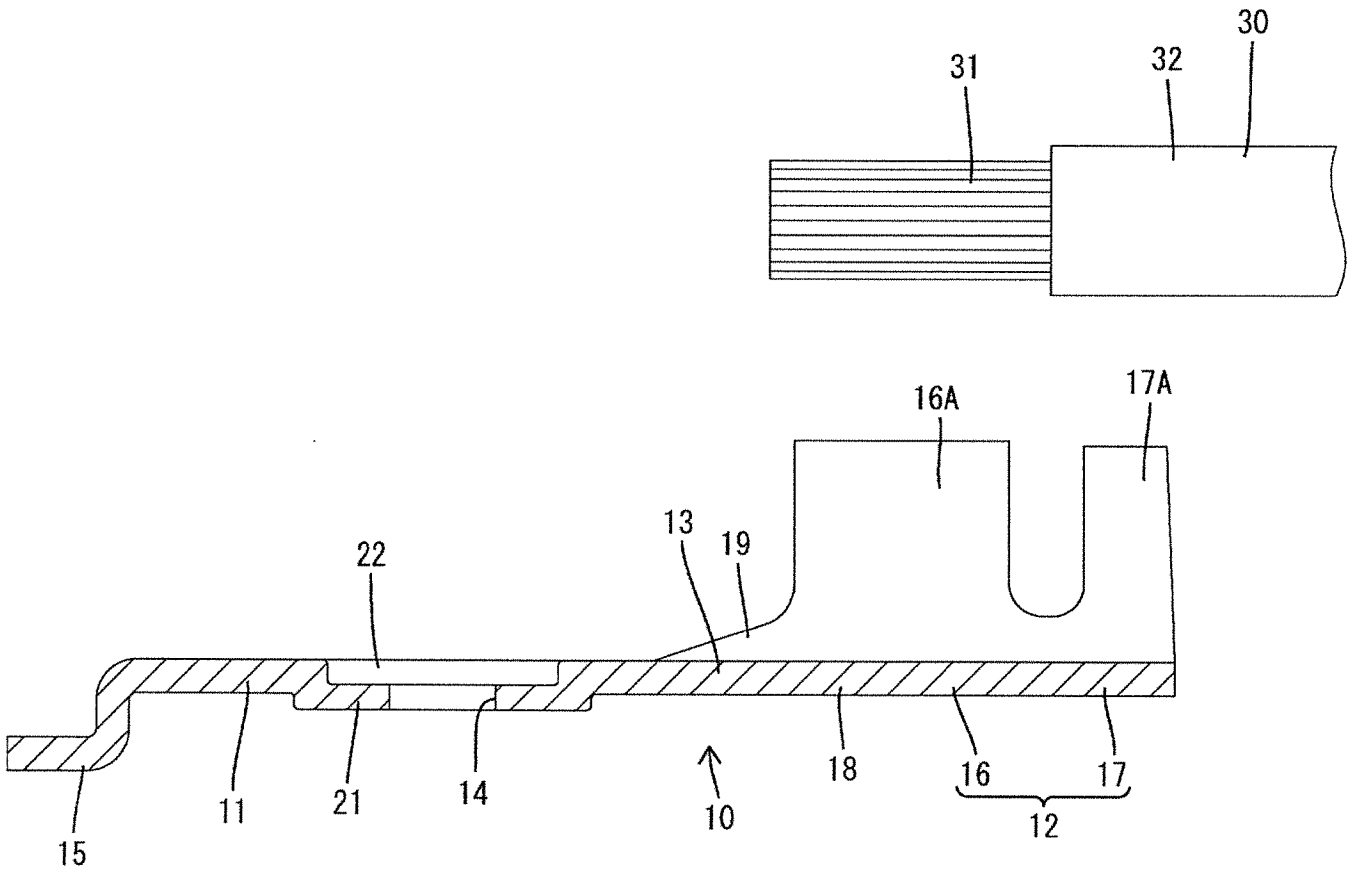
FIG. 4 is a section showing a state of connecting the ground terminal fitting to a wire.

The bolt fastening portion 11 and the bottom plate 18 of the wire connecting portion 12 are flush with each other (see FIG. 4). A substantially center of the linking portion 13 in the width direction is substantially horizontal (substantially parallel to the plate surface of the bolt fastening portion 11) from a front end to a rear end and there is no vertical step. A front end part of the linking portion 13 is connected to the bolt fastening portion 11 without any step and a rear end part thereof is connected to the core crimping portion 16 without any step.

Reinforcing portions 19 are provided on both side edge parts of the linking portion 13 and formed by being bent to rise upward. As shown in FIG. 3, an upward projecting dimension of the reinforcing portion 19 gradually increases from a front end to a rear end and the upper end surface of the reinforcing portion 19 is inclined up toward a rear side. The rear end of the reinforcing portion 19 is connected to a curved part of the bottom plate 18 in the core crimping portion 16. Note that a width of the linking portion 13 is substantially constant in a front-rear direction in a plan view, as shown in FIG. 2.

A protrusion 21 projects down (toward the ground part 40) in a central part of the bolt fastening portion 11. The protrusion 21 is formed around the bolt insertion hole 14 and has a ring shape continuous over the entire circumference of the bolt insertion hole 14. The protrusion 21 is formed by recessing a peripheral edge part of the bolt insertion hole 14 down, and a recess 22 is formed above the protrusion 21. As shown in FIG. 5, the recess 22 has a width equivalent to an outer diameter of a washer 43 and a recessed dimension equivalent to a thickness of the washer 43, and the washer 43 is accommodated entirely therein.

Figure 2:
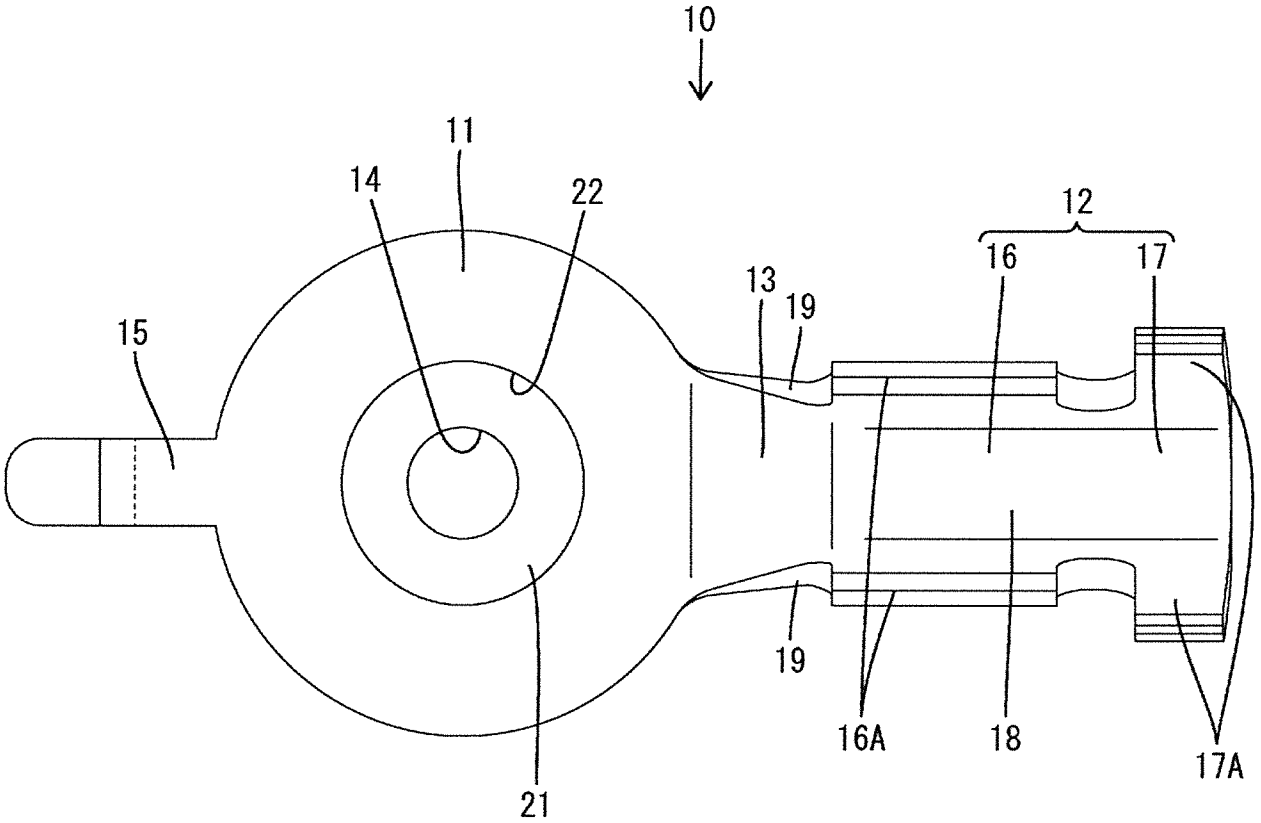
FIG. 2 is a plan view of the ground terminal fitting.
Figure 3:
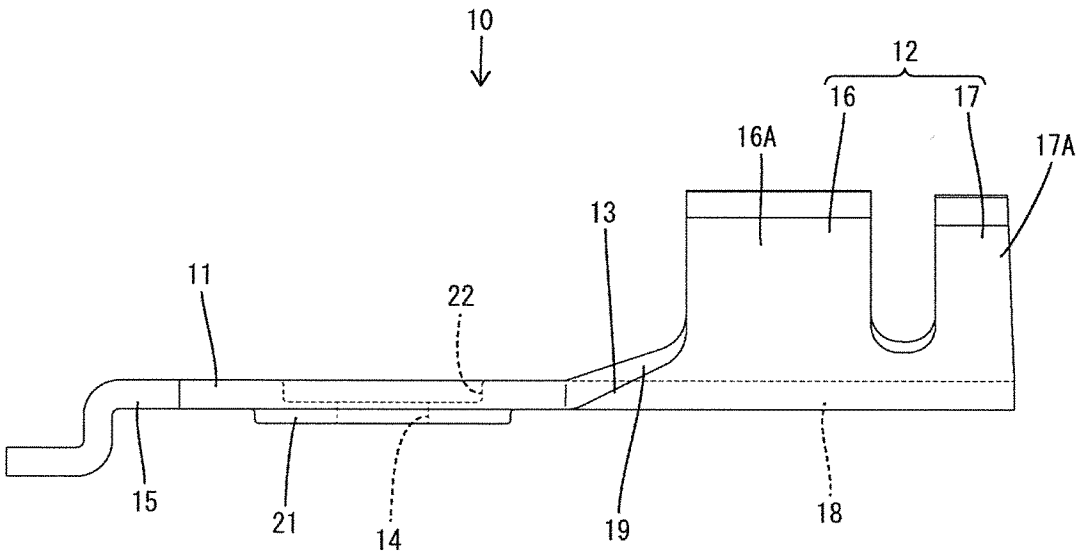
FIG. 3 is a side view showing the ground terminal fitting.

As shown in FIG. 2, the protrusion 21 has a constant width (radial dimension) over the entire circumference and has a circular ring shape in a plan view. A projecting dimension of the protrusion 21 is equivalent to or slightly larger than a thickness of a water stopping member 33, as shown in FIG. 5. The projecting dimension of the protrusion 21 is substantially constant over the entire circumference. A projecting surface (lower surface) of the protrusion 21 is a flat surface free from unevenness on its entirety and is entirely held in contact with the ground part 40.

The water stopping member 33 is applied to entirely surround a connecting part of the ground terminal fitting 10 and the wire 30 after the ground terminal fitting 10 is crimped to the wire 30. The water stopping member 33 makes the end part of the wire 30 waterproof by covering the entire wire connecting portion 12 (coating crimping portion 17 and core crimping portion 16), the entire exposed part of the core 31 and substantially the entire linking portion 13 from an end part of the insulation coating 32 of the wire 30.

As shown in FIG. 5, a heat shrinkable tube having an adhesive (not shown) applied to an inner peripheral surface may be mounted as the water stopping member 33. The heat shrinkable tube shrinks upon being heated at a predetermined temperature and is held in close contact with the ground terminal fitting 10 and the wire 30 via the adhesive after being mounted on the connecting part of the ground terminal fitting 10 and the wire 30.

Figure 6:
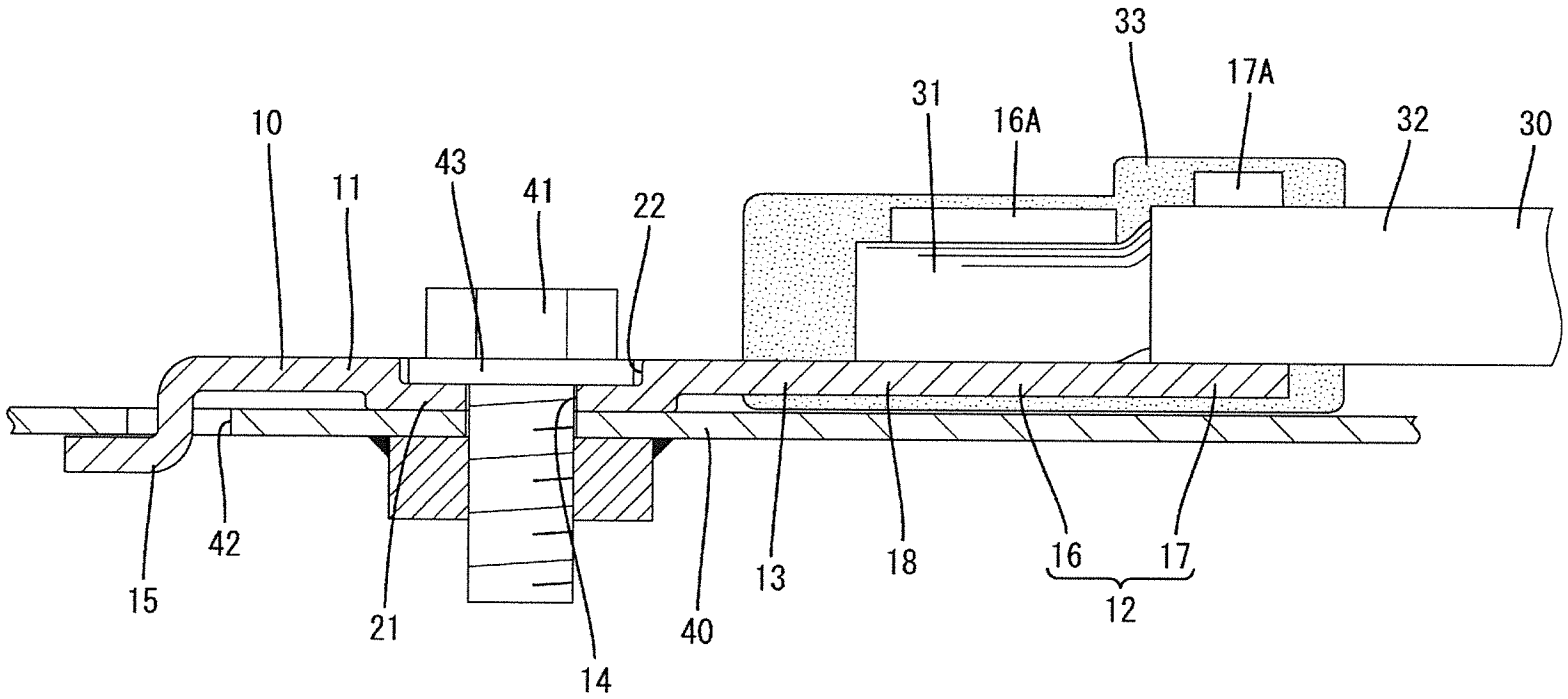
FIG. 6 is a section showing a state where the ground terminal fitting is connected to the wire and resin-molded.

Further, surrounding by a molded resin as shown in FIG. 6 may be adopted as the water stopping member 33. The molded resin is formed by setting the connecting part of the ground terminal fitting 10 and the wire 30 in a mold for molding (not shown) and injecting molten resin into that mold. The molded resin is tightly held in close contact with the entire connecting part of the ground terminal fitting 10 and the wire 30.

Next, functions and effects of the embodiment configured as described above are described.

The ground terminal fitting 10 of this embodiment includes the bolt fastening portion 11 to be fastened to the ground part 40 by the bolt 41 and the wire connecting portion 12 to be connected to the end part of the wire 30. The bolt fastening portion 11 and the bottom plate 18 of the wire connecting portion 12 are flush with each other. The protrusion 21 projects toward the ground part as provided a part of the bolt fastening portion 11 and extends around the bolt insertion hole 14 through which the bolt 41 is to be inserted.

According to this configuration, the protrusion 21 provided around the bolt insertion hole 14 comes into contact with the ground part 40 to lift the wire connecting portion 12 from the ground part 40, and a space for the water stopping member 33 is provided below the wire connecting portion 12. Thus, the linking portion 13 linking the bolt fastening portion 11 and the wire connecting portion 12 need not be formed into a bent shape so that a stress concentration on the linking portion 13 can be alleviated.

Further, the protrusion 21 has a ring shape by being continuously provided over the entire circumference of the bolt insertion hole 14. According to this configuration, since the protrusion 21 has a high strength, grounding can be established satisfactorily established.

The invention is not limited to the above described and illustrated embodiment. For example, the following embodiments also are included in the scope of the invention.

Although the protrusion 21 has a ring shape by being continuously provided over the entire circumference of the bolt insertion hole 14 in the above embodiment, there is no limitation to this. For example, a plurality of protrusions may be provided at predetermined intervals in a circumferential direction around a bolt insertion hole.

Although the protrusion 21 has a circular ring shape in a plan view in the above embodiment, there is no limitation to this. For example, a protrusion may have a rectangular shape in a plan view.

Although the heat shrinkable tube and the molded resin are illustrated as the water stopping member 33 in the above embodiment, there is no limitation to this. Various water stopping members can be used.

LIST OF REFERENCE SIGNS

10 . . . ground terminal fitting
11 . . . bolt fastening portion
12 . . . wire connecting portion
14 . . . bolt insertion hole
18 . . . bottom plate portion
21 . . . protrusion
30 . . . wire
40 . . . ground part
41 . . . bolt

The invention claimed is:

1. A ground terminal fitting, comprising:

a bolt fastening portion to be bolted to a ground part; and a wire connecting portion to be connected to an end part of a wire, wherein:

the bolt fastening portion and a bottom plate portion of the wire connecting portion are arranged flush with each other;

a protrusion projecting more toward the ground part than an outer edge part of the bolt fastening portion is provided on a part of the bolt fastening portion around a bolt insertion hole through which a bolt is to be inserted;

a projecting dimension of the protrusion is set to project more toward the ground part than a water stopping member configured to make the end part of the wire waterproof;

a linking portion linking the bolt fastening portion and the wire connecting portion is connected to the outer edge part of the bolt fastening portion without any step; and a recess having a width equivalent to or larger than a width of the bolt is formed on a surface of the bolt fastening portion opposite to the ground part.

2. The ground terminal fitting of claim 1, wherein the protrusion has a ring shape by being provided over the entire circumference of the bolt insertion hole.

* * * * *